US008161689B1

(12) United States Patent
Butzen

(10) Patent No.: US 8,161,689 B1
(45) Date of Patent: Apr. 24, 2012

(54) FLASHING END DAM HAVING ANGULARLY ADJUSTABLE LEG

(76) Inventor: William J. Butzen, Menomonee Falls, WI (US)

( * ) Notice: Subject to any disclaimer, the term of this patent is extended or adjusted under 35 U.S.C. 154(b) by 0 days.

(21) Appl. No.: 12/578,777

(22) Filed: Oct. 14, 2009

(51) Int. Cl.
*E04D 1/36* (2006.01)

(52) U.S. Cl. ..... 52/58; 52/97

(58) Field of Classification Search ..... 52/58, 59, 52/60, 61, 62, 11, 13, 14, 15, 97
See application file for complete search history.

(56) References Cited

U.S. PATENT DOCUMENTS 2,023,425 A * 12/1935 Larson ..... 52/408
5,072,552 A * 12/1991 Sauder ..... 52/58
5,109,641 A * 5/1992 Halan ..... 52/62
5,349,792 A * 9/1994 Bayes ..... 52/62
5,675,939 A * 10/1997 Hickner ..... 52/58
5,815,986 A 10/1998 Laska
6,070,370 A * 6/2000 Locke ..... 52/58
6,681,530 B1 * 1/2004 Givens ..... 52/58

* cited by examiner

*Primary Examiner* — Branon Painter
(74) *Attorney, Agent, or Firm* — Boyle Fredrickson, S.C.

(57) ABSTRACT

A flashing end dam having an angularly adjustable leg (adjustable end dam) includes a bottom leg, and adjustable rear leg, a side leg and a moveable web. The adjustable end dam is bent from a blank such that the bottom leg and the adjustable rear leg are formed, while bending a portion of the bottom leg and the adjustable rear leg to form the side leg and the moveable web. The adjustable end dam may be installed above a window opening in a masonry wall. The adjustable end dam is normally placed in a corner above and past the window opening. However, the adjustable end dam may be installed in any suitable application. If a nonparallel cavity variation exists between the structural wall and the exterior facing, the adjustable rear leg of the adjustable end dam may be bent back or forward to span the cavity.

17 Claims, 7 Drawing Sheets

FLASHING END DAM HAVING ANGULARLY ADJUSTABLE LEG

BACKGROUND OF THE INVENTION

1. Field of the Invention

The present invention relates generally to flashing end dams and more specifically to a flashing end dam having an angularly adjustable leg that may be tilted to adjust for variations in the wall assembly.

2. Discussion of the Prior Art

An end dam, which is an accessory to be used with "through-wall flashing," a commonly used construction component, prevents intruding water from entering the interior of a building. The intruding water originates at an elevation higher than that of the "through-wall flashing". The usual sources of intruding moisture are leaky windows, brickwork or roofing materials that allow moisture to enter the cavity of the wall and drain down, until the moisture reaches the "through-wall flashing." The through-wall flashing is designed to divert the moisture out through the exterior facing component of the wall. For the sake of this application, the facing component is shown on the sketches as brick, but could be any other facing component such as stone, precast concrete, E.I.F.S. or the like.

When the intruding moisture drains down to the "through-wall flashing", the intruding moisture is channeled through weep holes in the exterior facing component at the "through-wall flashing" level. The end dam is placed at the end of "through-wall flashing" to divert the intruding moisture to the weep holes, preventing the intruding moisture from running off the end of the "through-wall flashing".

U.S. Pat. No. 5,815,986 to Laska discloses a masonry end dam. The Laska patent includes an end dam for a wall assembly that includes three orthogonal rectilinear planar structures each joined, at a common corner and two adjacent sides, and an adhesive disposed along an outer surface of at least one of the three planar structures. However, the Laska device is not structured to be fully adjustable for variations in a masonry wall.

Accordingly, there is a clearly felt need in the art for a flashing end dam having an angularly adjustable leg, which includes a leg that may be tilted to adjust for a nonparallel cavity variation between inner and outer components.

SUMMARY OF THE INVENTION

The present invention provides a flashing end dam having an angularly adjustable leg, which includes a leg that may be tilted to adjust for a nonparallel cavity variation between inner and outer components of a wall assembly. The flashing end dam having an angularly adjustable leg (adjustable end dam) includes a bottom leg, an adjustable rear leg, a side leg and a movable web. The adjustable end dam is preferably fabricated from a single piece of seamless metal or other membrane type material. An end dam blank for forming the adjustable end dam has a square or rectangular shape. The end dam blank is bent, such that the bottom leg and the adjustable rear leg are formed, while bending a portion of the bottom leg and the adjustable rear leg to form the side leg and the movable web. A height of the side leg and the movable web are preferably less than a height of the adjustable rear leg. The rear adjustable leg may be bent back to an angle, which is greater than 90 degrees.

The adjustable end dam may be installed above or at the bottom of a window opening in a wall assembly. A lintel is placed over a top of the window opening to support a plurality of bricks over the window opening. A through-wall flashing is placed over the lintel and over the adjustable end dam. The adjustable end dam is normally placed in a corner above and past the window opening. If a nonparallel cavity variation exists between inner and outer wall components, the adjustable rear leg if the adjustable end dam may be bent back or forward to contact a support surface, (such as the lintel or the through-wall flashing).

Accordingly, it is an object of the present invention to provide an adjustable end dam, which includes a leg that my be tilted to adjust for a nonparallel cavity variation between inner and outer wall components.

Finally, it is another object of the present invention to provide an adjustable end dam, which includes metal folds that provide a watertight pan without the need for soldering, welding, caulking or sealants.

These and additional objects, advantages, features and benefits of the present invention will become apparent from the following specifications.

DETAILED DESCRIPTION OF THE PREFERRED EMBODIMENTS

Figure 1:
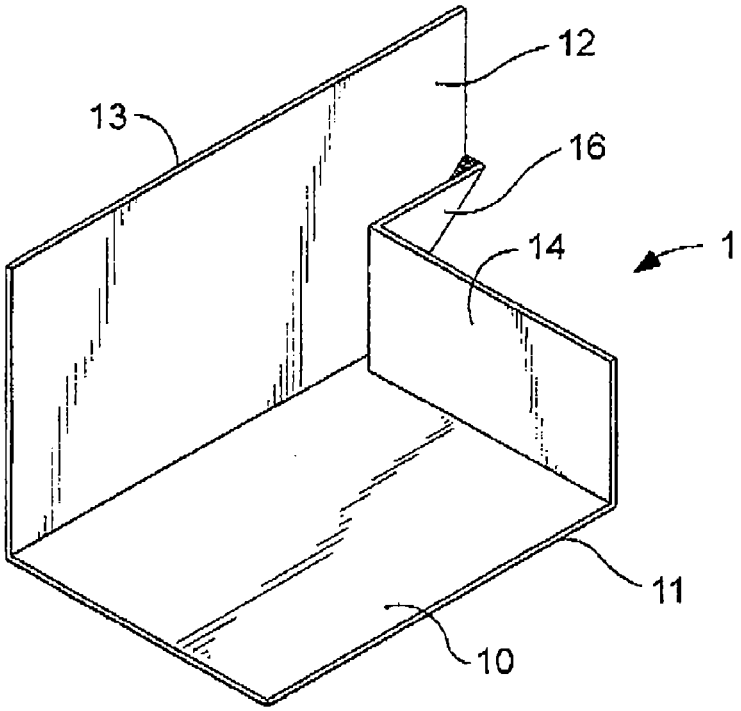
FIG. 1 is a perspective view of a right hand adjustable end dam in accordance with the present invention.
Figure 1A:
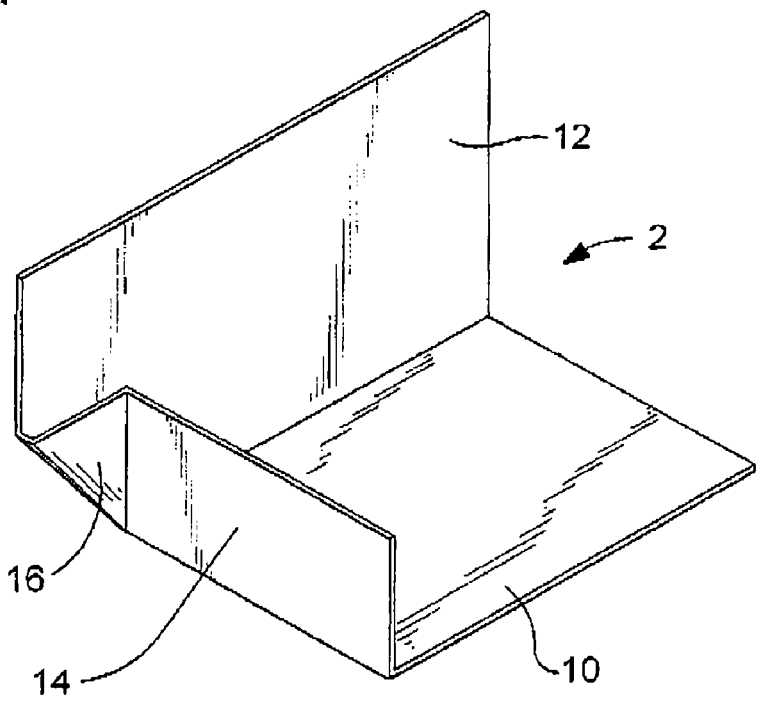
FIG. 1*a* is a perspective view of a left hand adjustable end dam in accordance with the present invention.

With reference now to the drawings, and particularly to FIG. 1, there is shown a perspective view of an adjustable end dam 1. The adjustable end dam 1 includes a bottom leg 10, and adjustable rear leg 12, a side leg 14 and a moveable web 16. The bottom leg 10 is normally substantially perpendicular to the adjustable rear leg 12 and the side leg 14. A right hand adjustable end dam 1 is shown in FIG. 1 and a left hand adjustable end dam 2 is shown in FIG. 1*a*.

Figure 2:
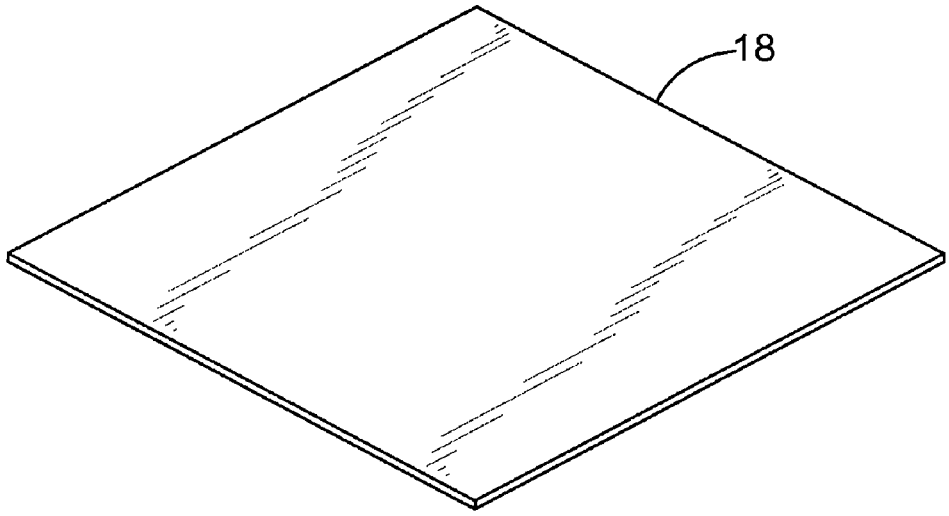
FIG. 2 is a perspective view of an end dam blank used to create an adjustable end dam in accordance with the present invention.
Figure 3:
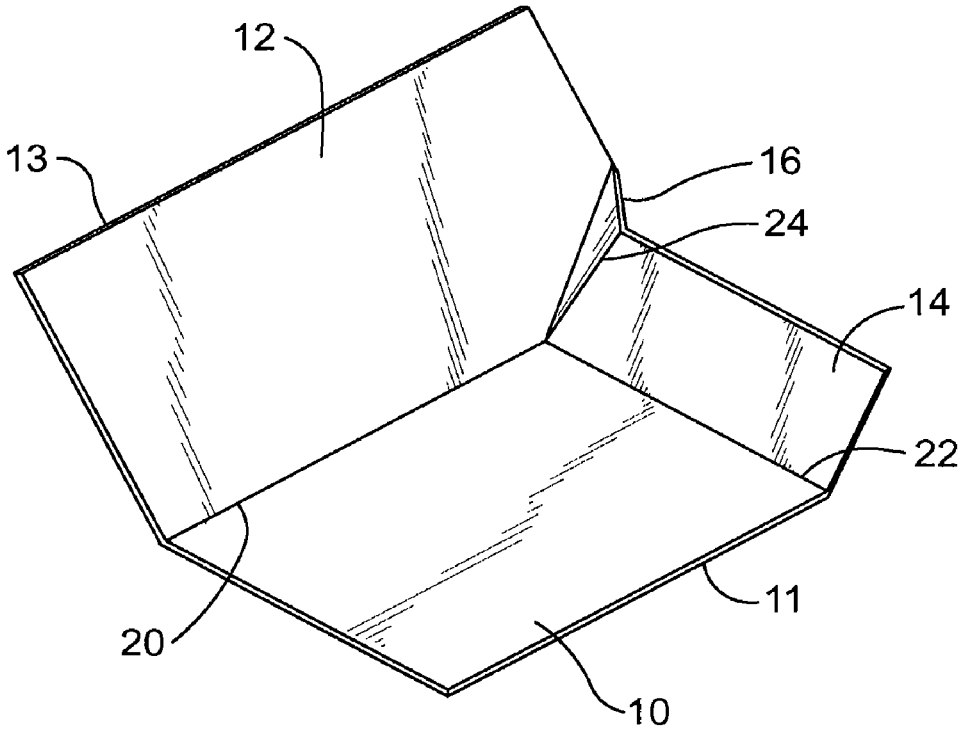
FIG. 3 is a perspective view of an end dam blank partially folded to create and adjustable end dam in accordance with the present invention.
Figure 4:
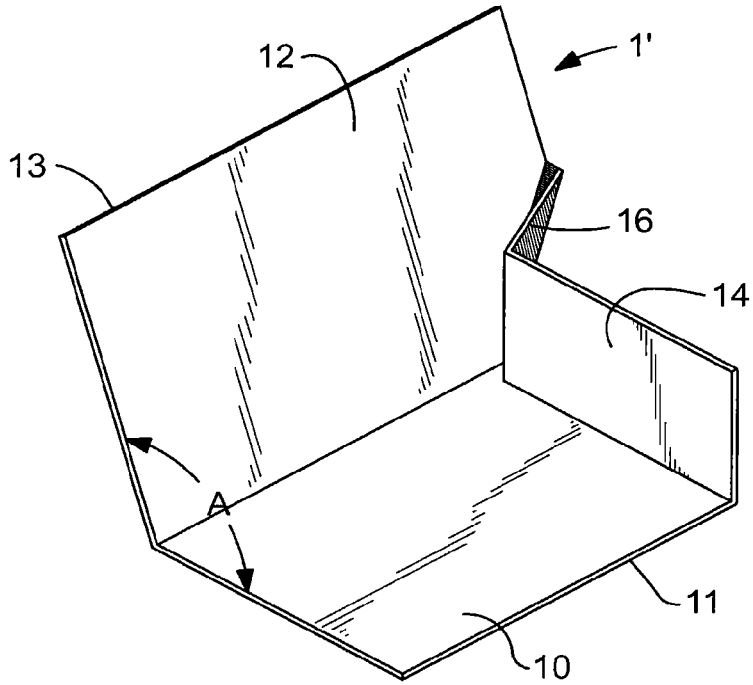
FIG. 4 is a perspective view of an adjustable end dam with a rear leg tilted back at an obtuse angle in accordance with the present invention.

With reference to FIG. 2, the adjustable end dam 1 is preferably fabricated from a single piece of seamless metal material. An end dam blank 18 for forming the adjustable end dam 1 preferably has a rectangular or square shape. With reference to FIG. 3, the end dam blank 18 is bent, such that a rear crease line 20 forms the bottom leg 10 and the adjustable rear leg 12, while a side crease line 22 forms the side leg 14 and a web crease line 24 forms the moveable web 16. A height of the side leg 14 and the moveable web 16 are preferably less than a height of the adjustable rear leg 12. With reference to FIG. 4, the adjustable rear leg 12 of the adjustable end dam 1' may be bent back to an obtuse angle A or forward to a 90 degree angle, while making a front edge 11 of the bottom leg 10 substantially parallel to a top edge 13 of the adjustable rear leg 12.

Figure 5:
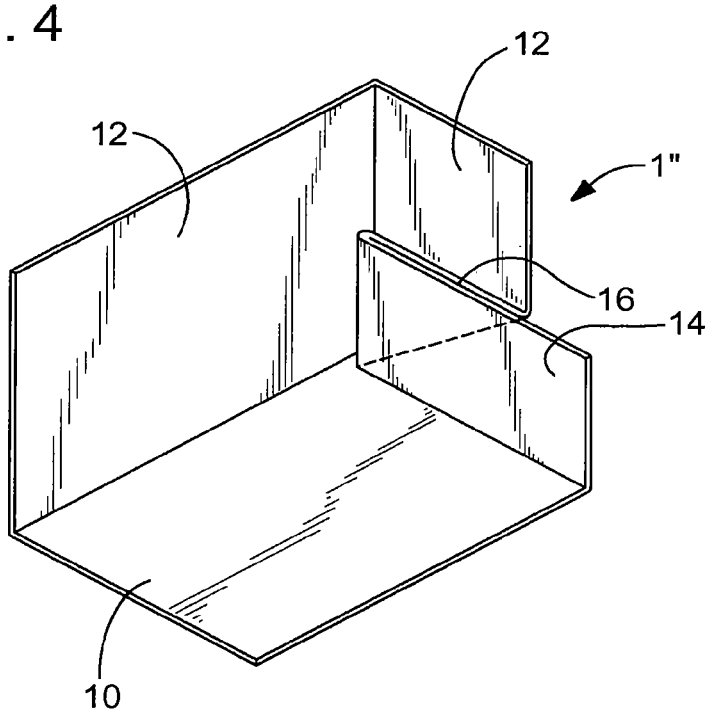
FIG. 5 is a perspective view of an adjustable end dam with a rear leg and a moveable web bent against a side leg to form a nonadjustable end dam embodiment in accordance with the present invention.

With reference to FIG. 5, an end of the adjustable rear leg 12 and the moveable web 16 are bent 90 degrees against the side leg 14 to form a nonadjustable end dam 1". The nonadjustable end dam 1" will fit in a corner without a cavity for the movable web 16. The nonadjustable end dam 1" would still provide a watertight corner, but the adjustable angle feature of the rear leg 12 would be lost.

Figure 6:
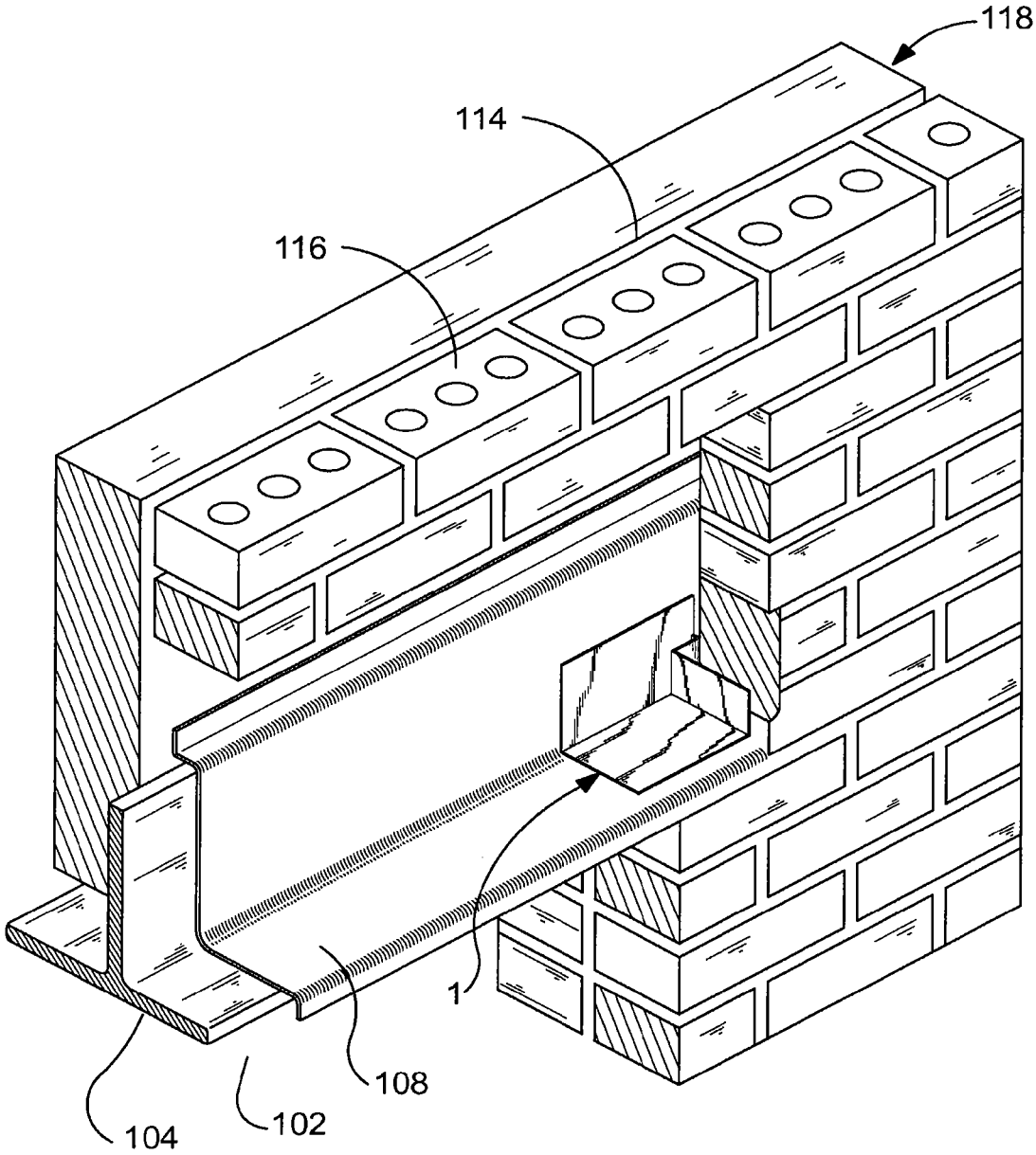
FIG. 6 is a perspective view of a wall assembly with an adjustable end dam installed over a through-wall flashing and a lintel in accordance with the present invention.

With reference to FIG. 6, the adjustable end dam may be installed above a window opening 102, in a wall assembly 100. A lintel 104 is placed over a top of the window opening 102 to support a plurality of bricks 116 over the window opening 102. The adjustable end dam 1 is normally placed in a corner above and past the window opening 102. A through-wall flashing 108 is then installed. The adjustable end dam 1 is installed over the through-wall flashing 108. The through-wall flashing 108 is either a metal type (as shown in FIG. 6) or a flexible membrane type.

Figure 7:
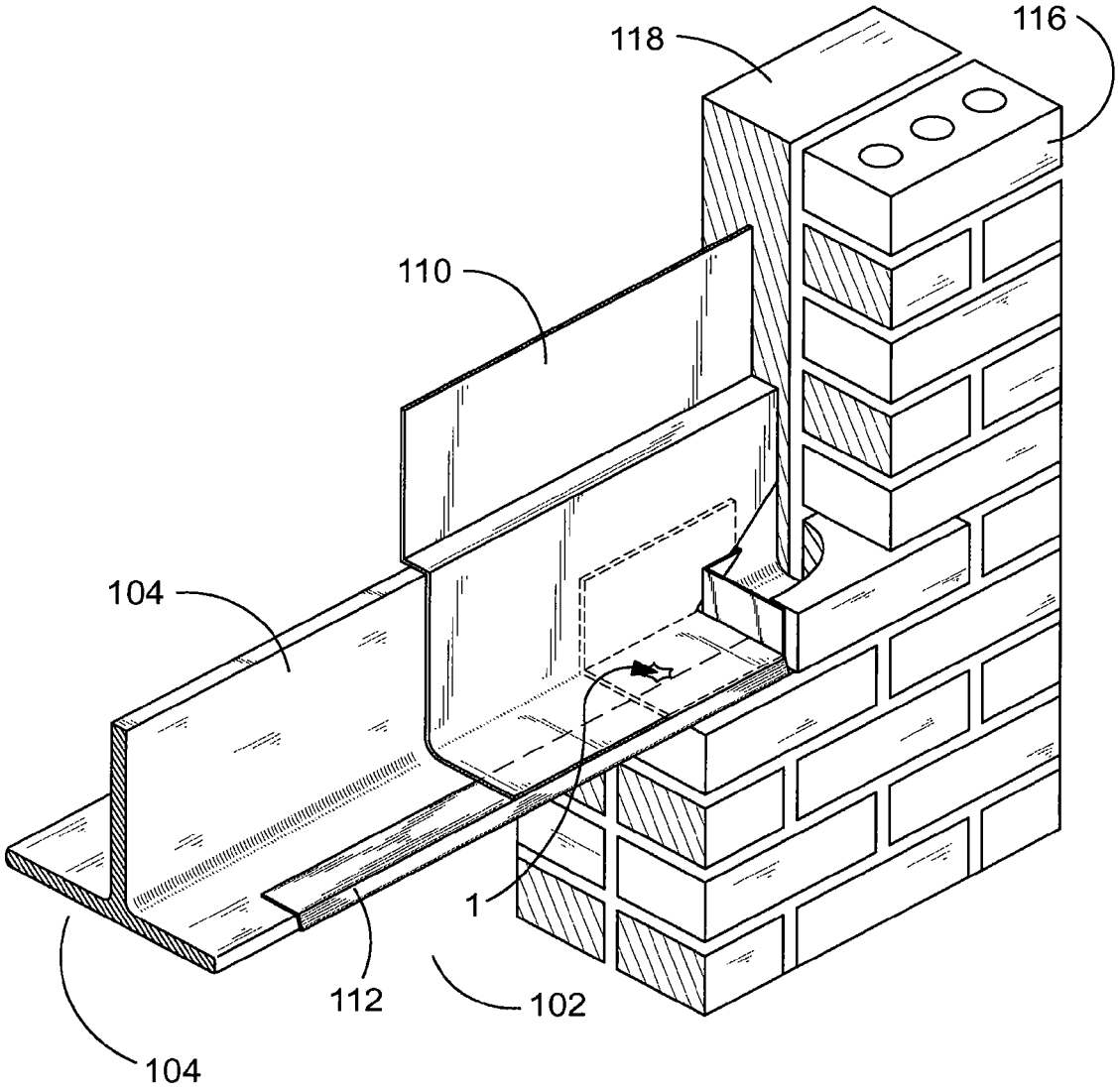
FIG. 7 is a perspective view of a wall assembly with an adjustable end dam installed between a through-wall flashing and a lintel in accordance with the present invention.

With reference to FIG. 7, a flexible membrane type of through-wall flashing 110 is shown. The adjustable end dam 1 is placed directly on the lintel 104. A metal drip edge 112 is installed on an edge of the lintel 104 and over the adjustable end dam 1. The through-wall flashing 110 is installed over the metal drip edge 112 and the adjustable end dam 1. The flexible membrane type of through-wall flashing 110 is made of a flexible material that does not provide an attractive bottom edge. The metal drip edge 112 is used to provide the attractive bottom edge.

Figure 8:
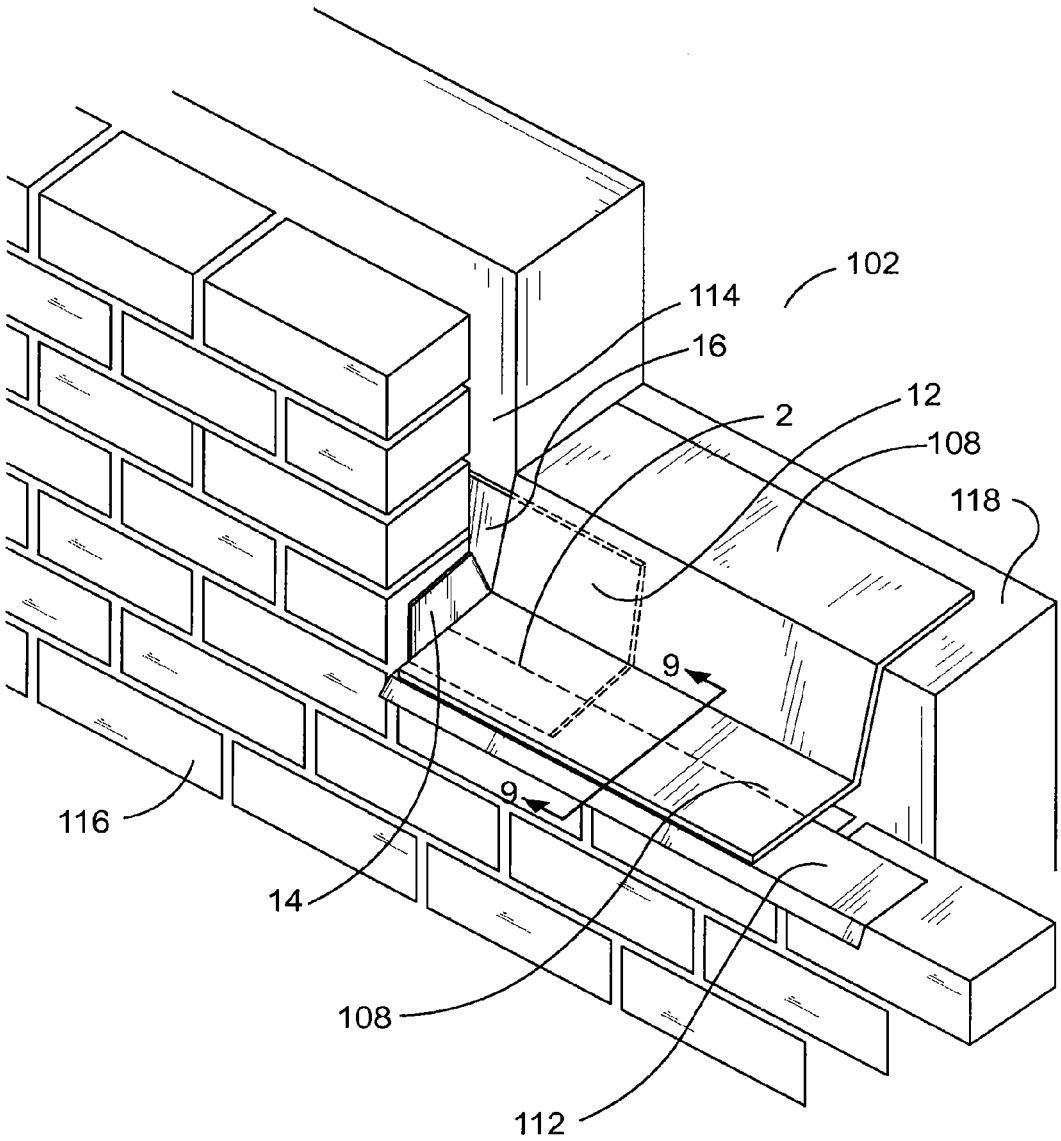
FIG. 8 is a perspective view of a wall assembly with a window opening included and an adjustable end dam installed in a cavity between the brick exterior facing and the structural wall in accordance with the present invention.
Figure 9:
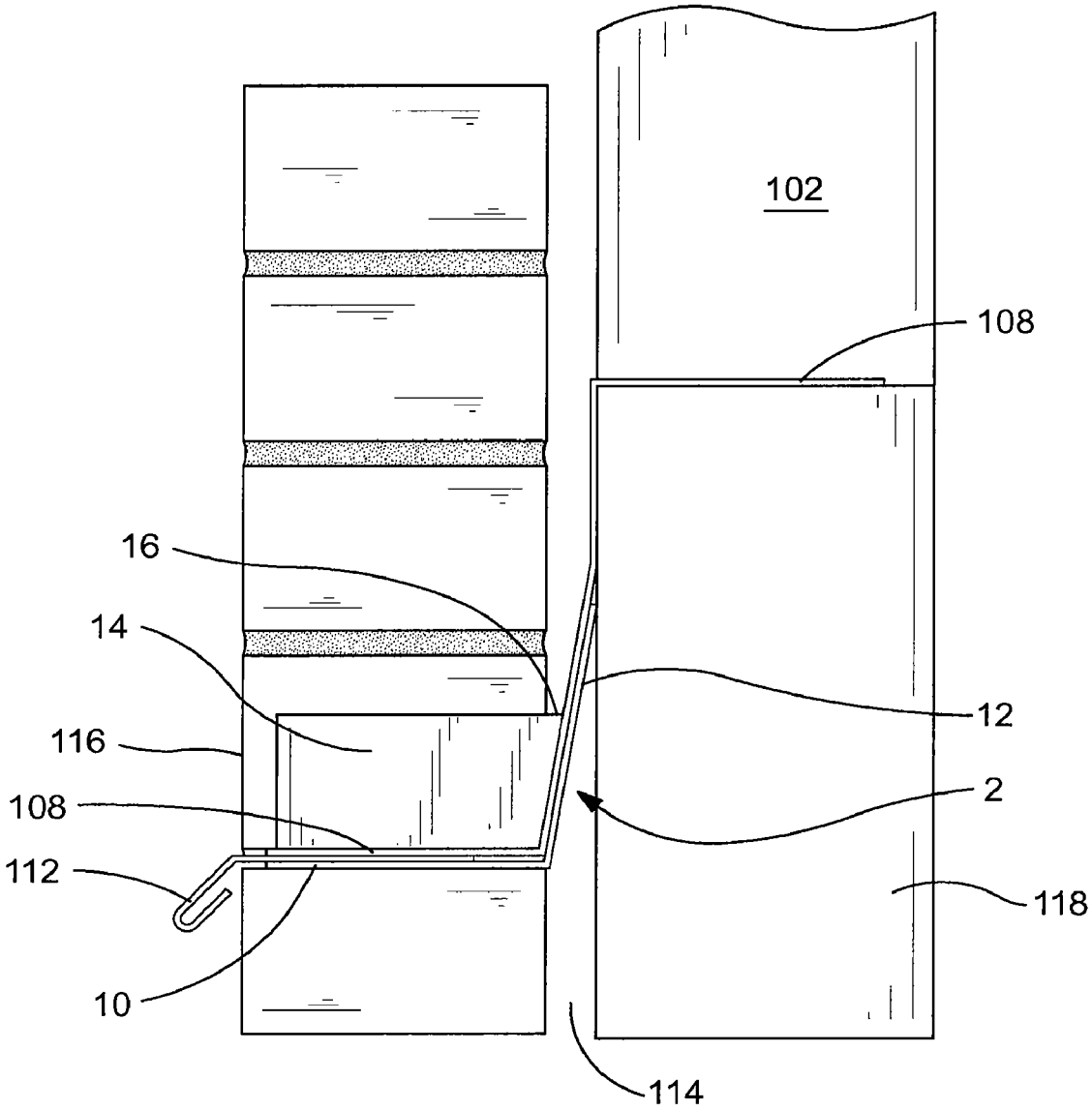
FIG. 9 is an end view of a wall assembly with a cavity between structural wall and the exterior facing; an adjustable rear leg is bent to contact a structural wall in accordance with the present invention.

With reference to FIGS. 8-9, a cavity 114 exists between an exterior facing 116 and a structural wall 118. The rear leg 12 of the adjustable end dam 1 is bent back to contact the structural wall 118. The moveable web 16 is inserted into the cavity 114. A metal drip edge 112 is placed over the adjustable end dam 1 for appearance purposes. The adjustable end dam 1 is fabricated from a metal, which provides a mason with a surface that is dry and acceptable for the sealant required for bonding with an adjacent through-wall flashing 108.

While particular embodiments of the invention have been shown and described, it will be obvious to those skilled in the art, that changes and modifications may be made without departing from the invention in its broader aspects, and therefore, the aim in the appended claims is to cover all such changes and modifications as fall within the true spirit and scope of the invention.

I claim:

1. An adjustable end dam, comprising:

a bottom leg having an upper surface and a rear edge;

an adjustable rear leg projecting from the rear edge of the bottom leg and having an inner surface, a first side edge and a second side edge, the adjustable rear leg being adjustable with respect to the bottom leg;

a side leg bent from an end of said bottom leg, the side leg having an inner surface, an outer surface and a rear edge; and a movable web extending between the rear edge of the side leg and the first side edge of the adjustable rear leg, the movable web having an outer surface and an inner surface directed towards the rear leg, the movable web being planar, and the inner surface of the movable web being substantially parallel to a surface of the adjustable rear leg;

wherein:

the upper surface of the bottom leg, the inner surface of the side leg and at least a portion of the inner surface of the rear leg define a first cavity for receiving at least a portion of a first brick therein;

the outer surface of the side leg and the outer surface of the movable web define a second cavity for receiving at least a portion of a second brick therein; and the outer surface of the side leg and the outer surface of the movable web define a fluid barrier between the first and second cavities.

2. The adjustable end dam of claim 1 wherein:

said adjustable end dam is fabricated from a blank.

3. The adjustable end dam of claim 2 wherein:

said blank has one of a rectangular and a square shape.

4. The adjustable end dam of claim 2 wherein:

a height of said side leg is less than a height of said adjustable rear leg.

5. The adjustable end dam of claim 1 wherein:

an entire portion of said adjustable rear leg is bendable to an obtuse angle relative to said bottom leg.

6. The adjustable end dam of claim 1 wherein:

a boundary between said bottom leg and said adjustable rear leg is defined by a rear crease line, a boundary between said bottom leg and said side leg is defined by a side crease line, and a boundary between said side leg and said moveable web is defined by a web crease line.

7. The adjustable end dam of claim 1 wherein:

an end of each of said adjustable rear leg and said movable web is bent to contact said side leg, such that said adjustable end dam fits in a corner without a cavity.

8. An adjustable end dam for mounting adjacent a structural wall, comprising:

a bottom leg having an upper surface and a rear edge;

an adjustable rear leg having a first side edge and an opposing second side edge, the adjustable rear leg extending from the rear edge of the bottom leg and having an inner surface at least partially defining a first cavity for receiving a first brick therein, the entirety of the rear leg being pivotable between a forward position and a rearward position wherein the rear leg and the bottom leg define an obtuse angle;

a side leg extending from the upper surface of the bottom leg and toward the adjustable rear leg, the side leg having a rear edge positioned toward the adjustable rear leg; and a movable web interconnecting the adjustable rear leg and the side leg, the movable web extending from the first side edge of the adjustable rear leg towards the second side edge of the adjustable rear leg, the movable web terminating at the rear edge of the side leg;

wherein the bottom leg, the movable web, and the rear leg define a fluid barrier having a first side at least partially defining a second cavity for receiving a second brick, the fluid barrier preventing the flow of fluid between the first and second cavities.

9. The adjustable end dam of claim 8 wherein:

said adjustable end dam is fabricated from a blank.

10. The adjustable end dam of claim 9 wherein:

said blank has one of a rectangular and a square shape.

11. The adjustable end dam of claim 9 wherein:

the movable web has one end extending from the side leg and an opposing end extending from an end of the adjustable rear leg;

and wherein a height of said side leg is less than a height of said adjustable rear leg.

12. The adjustable end dam of claim 8 wherein:

the movable web has one end extending from the side leg and an opposing end extending from an end of the adjustable rear leg;

and wherein a boundary between said bottom leg and said adjustable rear leg is defined by a rear crease line, a boundary between said bottom leg and said side leg is defined by a crease line, and a boundary between said side leg and said moveable web is defined by a web crease line.

13. The adjustable end dam of claim 8 wherein:

the movable web has one end extending from the side leg and the other end extending from an end of the adjustable rear leg;

and wherein an end of each of said adjustable rear leg and said movable web is bent to contact said side leg, such that said adjustable end dam fits in a corner without a cavity.

14. The adjustable end dam of claim 8 wherein the movable web is substantially planar.

15. An adjustable end dam, comprising:

a bottom leg having a first end and an opposing second end, the bottom leg having a rear edge extending between the first and second ends;

an adjustable rear leg projecting from the rear edge of the bottom leg, the adjustable rear leg having a first end positioned toward the first end of the bottom leg and a second end that is positioned toward the second end of the bottom leg, the adjustable rear leg being adjustable with respect to the bottom leg;

a first crease defined between the bottom leg and the adjustable rear leg;

a side leg extending from the first end of the bottom leg, the side leg having an inwardly disposed end that is positioned toward the adjustable rear leg and an outwardly disposed end that is positioned away from the adjustable rear leg;

a second crease defined between the bottom leg and the side leg, the second crease extending generally orthogonally with respect to the first crease;

a movable web interconnecting the inwardly disposed end of the side leg and the first side of the adjustable rear leg;

a third crease defined between the side leg and the movable web, the third crease extending generally orthogonally with respect to the bottom leg; and a fourth crease defined between the movable web and the adjustable rear leg, the fourth crease extending angularly with respect to the bottom leg.

16. The adjustable end dam of claim 15 wherein the movable web includes a top edge that extends generally parallel to the bottom leg.

17. The adjustable end dam of claim 16 wherein the movable web defines a triangular perimeter shape such that (i) the top edge defines a first portion of the triangular perimeter shape, (ii) the third crease defines a second portion of the triangular perimeter shape, and (iii) the forth crease defines a third portion of the triangular perimeter shape.

* * * * *